United States Patent [19]

Pratt

[11] Patent Number: 4,531,397

[45] Date of Patent: Jul. 30, 1985

[54] CRIMPING TOOL

[76] Inventor: Rodger Pratt, 5436 106th Ave. NE., Kirkland, Wash. 98033

[21] Appl. No.: 557,334

[22] Filed: Dec. 2, 1983

[51] Int. Cl.[3] ..... B21J 9/18

[52] U.S. Cl. ..... 72/451; 72/410; 29/509; 29/243.5

[58] Field of Search ..... 72/409, 410, 451, 412; 29/21.1, 509, 521, 243.5, 243.58; 81/57.44, 9.1

[56] References Cited

U.S. PATENT DOCUMENTS

| | | | |
|---|---|---|---|
| 1,743,209 | 1/1930 | Groehn | 72/451 |
| 1,843,935 | 2/1932 | Stevens | 72/451 |
| 2,696,850 | 12/1954 | Peterson | 140/113 |
| 2,931,260 | 4/1960 | Townshend, Jr. | 72/409 |
| 2,941,430 | 6/1960 | Klinger . | |
| 2,968,202 | 1/1961 | Evans et al. . | |
| 2,992,576 | 7/1961 | Evans et al. | 72/410 |
| 2,996,939 | 8/1961 | Meier | 81/9.1 |
| 3,174,323 | 3/1965 | Over | 72/412 |
| 3,212,316 | 10/1965 | Smith et al. | 72/412 |
| 3,217,519 | 11/1965 | Demler . | |
| 3,451,250 | 6/1969 | Rolf et al. | 72/451 |
| 3,624,876 | 11/1969 | Irvin | 72/409 |
| 4,111,022 | 9/1978 | Kruschel | 72/410 |

*Primary Examiner*—Daniel C. Crane
*Assistant Examiner*—David B. Jones
*Attorney, Agent, or Firm*—Thomas W. Secrest

[57] ABSTRACT

This invention is directed to a power operated crimping tool having two movable links. On the lower end of one of the movable links there is a stud and on the lower end of the other movable link there is a recess. There is a power operated movable piston which operatively connects with a plunger. The plunger connects with toggles and in turn the toggles connect with an appropriate movable link. The operator can control the application of power to the power operated movable piston to move the pistons and thereby move the plunger and thereby move the toggles and the two movable links.

16 Claims, 17 Drawing Figures

CRIMPING TOOL

THE BACKGROUND OF THE INVENTION

In the construction of a modern office building, there is erected a steel skeleton. It is necessary to have floors in the office building. The floors are concrete floors.

The steel skeleton has steel beams. Steel forms are placed on the steel beams and also the supports for the floors. Then, freshly mixed concrete is poured onto the steel forms and allowed to cure. In order to have concrete floors it is necessary to definitely position the steel forms onto the beams and also onto the supports of the steel forms. Further, it is necessary to definitely position the steel forms with respect to each other. The steel forms are corrugated sheets of steel. On one side of the sheet of steel there is an upright edge. On the other sides of the sheet of steel there is an envelope to receive the upright edge of the adjacent sheet of steel.

The steel forms are laid on the beams and on the supports for the steel forms so that the envelope of the first steel form receives the upright edge of the second steel form, and, likewise, the envelope of the second steel form receives the upright edge of the third steel form. This is repeated until there are sufficient steel forms on the beams and on the supports of the steel forms to receive the freshly mixed, uncured concrete.

The adjacent steel forms are bonded together. At the present time the adjacent steel forms are manually bonded together by a manually operated crimping tool. The operator actuates the crimping tool and makes a dent in each side of the envelope of the steel form and also in the upright edge of the next adjacent steel form. The dent definitely positions the steel forms with respect to each other. Also, a welder may tack weld the steel form to the beams so as to definitely position the steel forms with respect to the beams.

After the steel forms have been positioned on the beams and onto the supports for the steel forms, and also definitely positioned with respect to each other, uncured concrete can be poured onto the top of the steel forms. The weight of the uncured concrete assists in positioning the steel forms onto the beams. In time, the concrete cures and bonds to the steel forms so as to position the steel forms onto the beams.

As previously stated, an operator manually crimps the adjacent steel forms to each other. The operator can take a crimping tool and walk on the steel forms and crimp together the adjacent steel forms. The manual crimping of the adjacent steel forms is a slow process as the operator cannot rapidly operate the manual crimping tool. Further, in time, the operator tires after operating the manual crimping tool and slows down in his work. With a manual crimping tool there are probably fewer indents for the sheets of steel as compared to my power operated crimping tool.

A BRIEF DESCRIPTION OF THE INVENTION

With this invention I am providing a power operated crimping tool. This crimping tool is operated by air pressure or is a pneumatic operated tool. It is conceivable that there may be a liquid operated tool but in industry the source of air pressure is common and therefore I am using air pressure as the source of power for the crimping tool.

The operator can position the jaws of the crimping tool on the outside of the envelope. The reader is to understand that inside of the envelope is the upright edge of the next adjacent steel form. After the operator has positioned the jaws on the outside of the envelope the operator can actuate the pneumatic valve. The jaws indent the envelope and the upright edge to join together these adjacent steel forms.

An advantage that I can see of my power operated crimping tool is that it is faster than a manually operated crimping tool with the resulting saving in time for crimping together adjacent steel forms. With the saving in time there is less expense involved in joining together the adjoining steel forms and therefor less expense in the construction of the building. Another advantage is that with the manually operated crimping tool there are probably more indents for adjacent steel forms. A further advantage is that a worker using my power operated crimping tool does not become as tired as the worker using the manual crimping tool and, I believe, that with the passage of time during the working day, that the operator using my power operated crimping tool will have higher quality work as compared with the worker using the manually operated crimping tool.

THE DRAWINGS

THE SPECIFIC DESCRIPTION OF THE INVENTION

Figure 1:
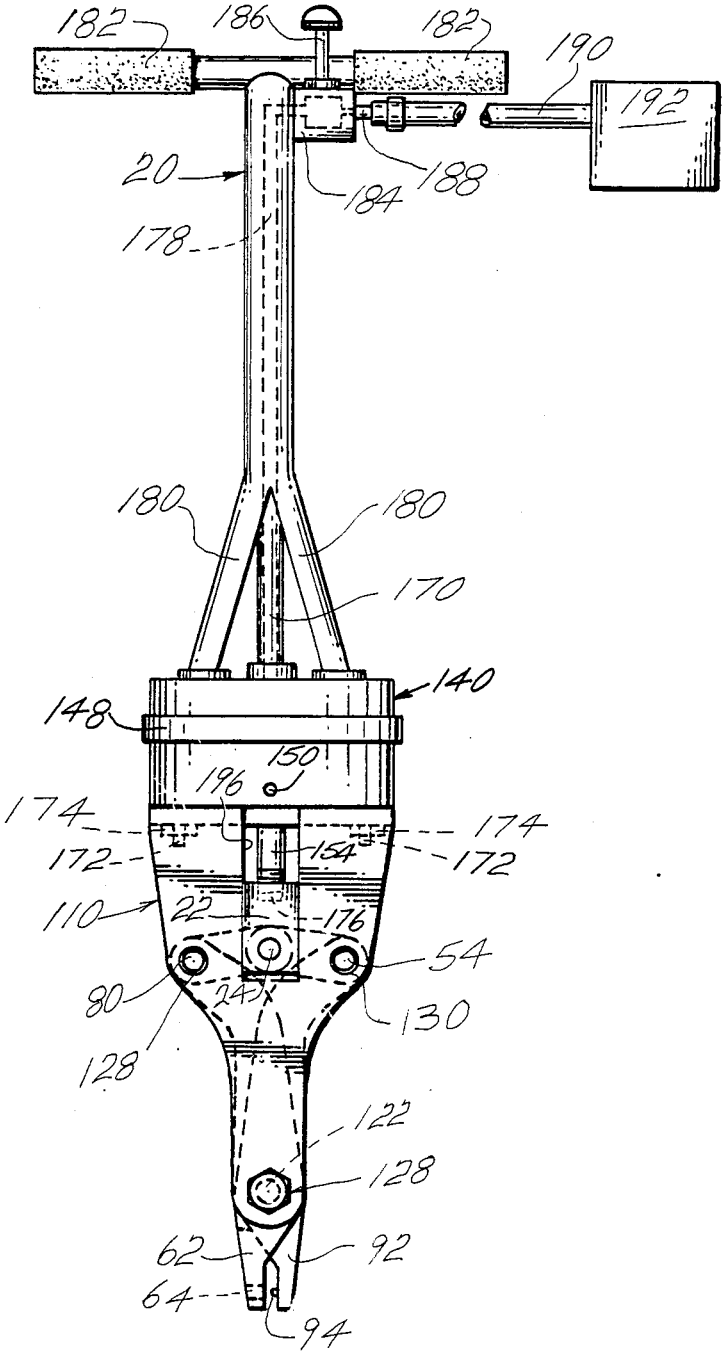
FIG. 1 is a side elevational view of the crimping tool with the jaws in a near closed position.
Figure 3:
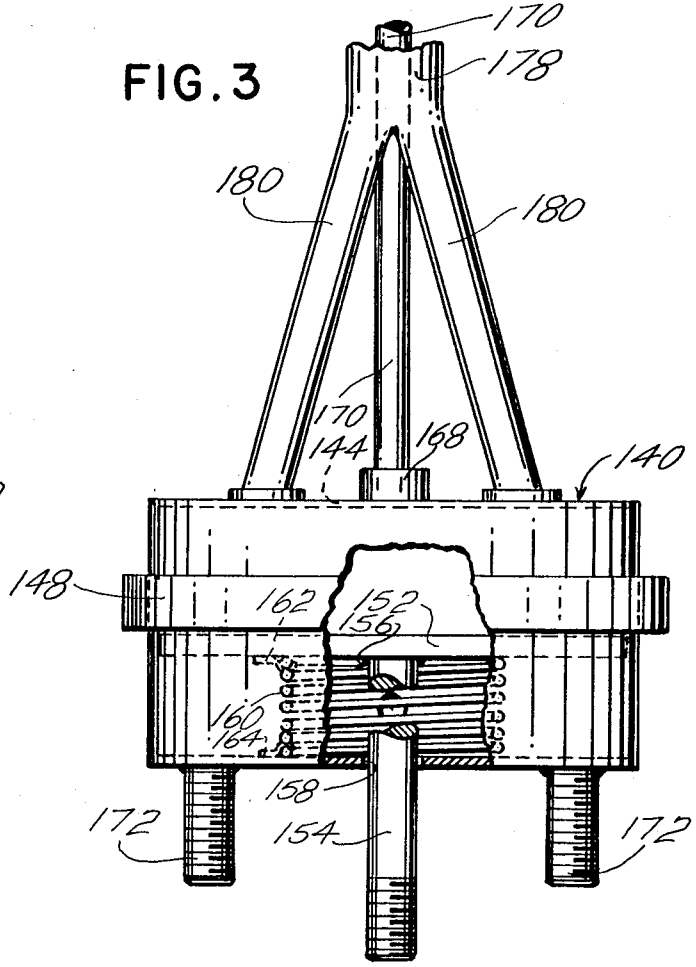
FIG. 3 is a fragmentary cross sectional side elevational view illustrating the piston in a downward position with the springs compressed and which means that the jaws are closed or crimping together the envelope and the upright edge of the next adjacent steel form.
Figure 2:
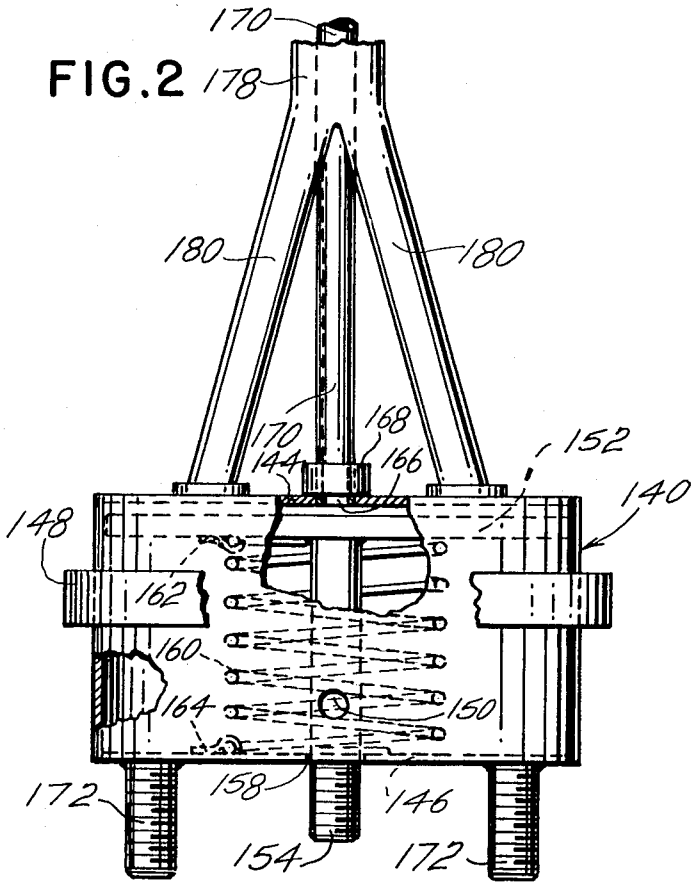
FIG. 2 is a fragmentary cross sectional view illustrating the piston at the top of the air cylinder with the spring expanded and which means that the jaws are in an open position.

In the drawings there is illustrated a crimping tool 20. Part of the crimping tool 20 is a plunger 22. There is a pin or shaft 24 in the plunger 22.

Figure 12:
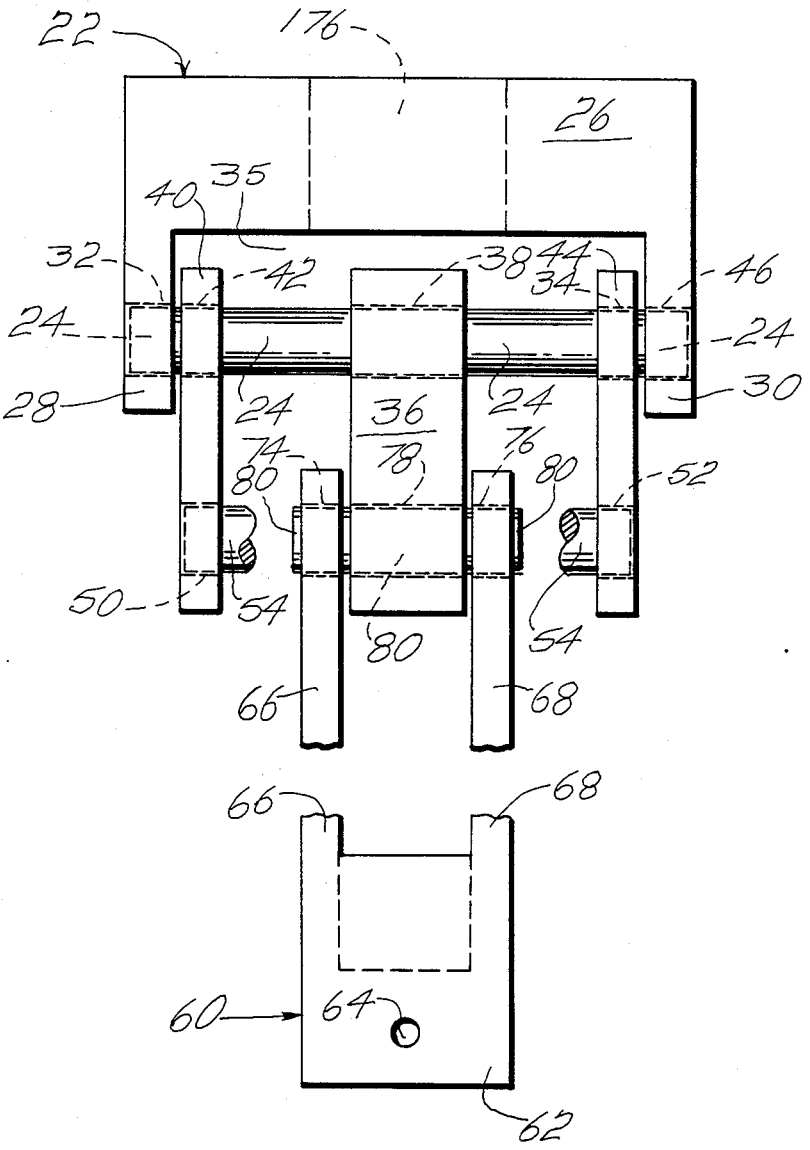
FIG. 12 is a fragmentary end elevational view of part of the frame and illustrates the plunger, toggle and links.

The plunger 22, see FIG. 12, is of a generally U-configuration having a base 26 and a first leg or left leg 28 and a second leg or a right leg 30.

In the leg 28 is a first passageway, 32. In the leg 30 there is a second passageway 46 . In FIG. 12 it is seen that the pin 24 is in the first passageway 32 and also in the second passageway 46.

The base 26, the legs 28 and 30 define a recess 35.

In the recess 35 there is a single toggle 36. In the upper part of the toggle 36 there is a third passageway 38. In FIG. 12 it is seen that the pin or shaft is in the third passageway 38 of the single toggle 36.

There is a double toggle comprising a first member 40 having a fourth passageway 42 and comprising a second member 44 having a fifth passageway 34 . The pin or shaft 24 is in the fourth passageway 42 and the fifth passageway 34.

The members 40, 36 and 44 are in the recess 35 of the plunger 22.

In the first member 40 there is a sixth passageway 50. In the second member 44 there is a seventh passageway 52. A pin 54 is in the sixth passageway 50 and the seventh passageway 52.

Figure 14:
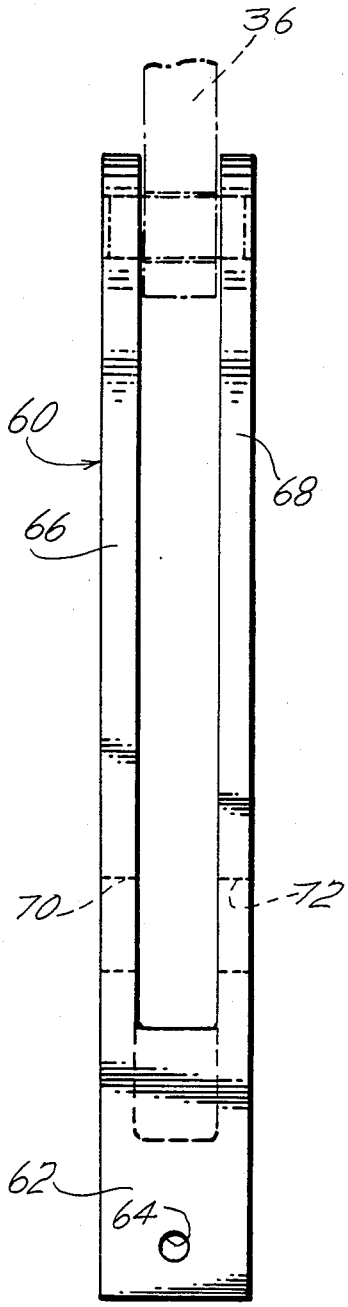
FIG. 14 is an end elevational view of the double link and single toggle and illustrates the jaw and recess.
Figure 13:
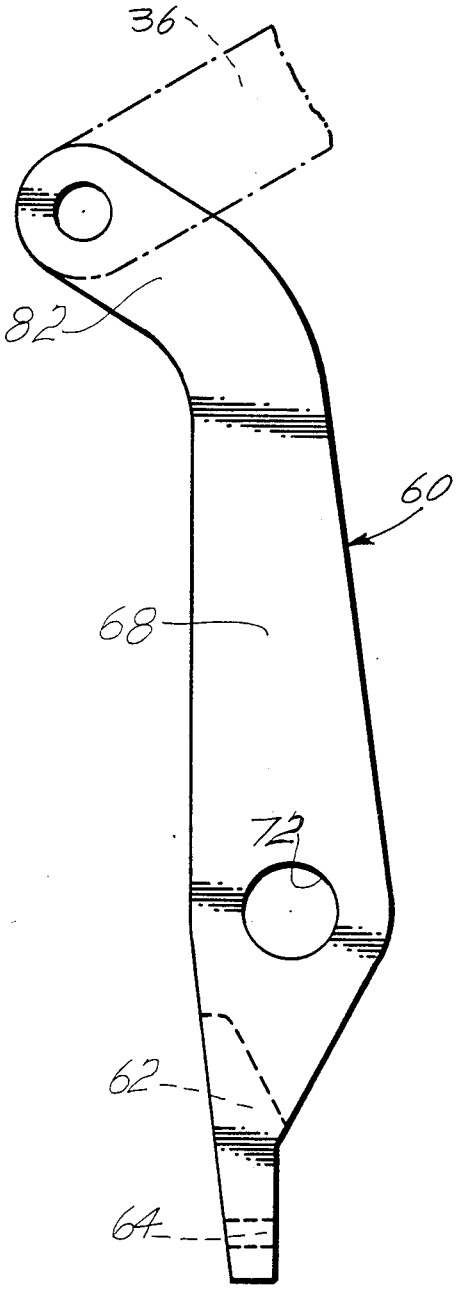
FIG. 13 is a side elevational view illustrating the double link with the jaw and recess and a single toggle.

The single toggle 36 co-operates with a double link 60 having a base 62. In the base 62 there is a recess 64. The double link 60 has a first arm 66 and a second arm 68. The upper part of the double link 60 receives the single toggle 36. In the first arm 66, near the base 62, there is an eighth passageway 70. As seen in FIG. 14 in the second arm 68 near the base 62 there is a ninth passageway 72. The passageways 70 and 72 are aligned. In the upper part of the first arm 66 there is a tenth passageway 74 and in the upper part of the second arm 68 there is an eleventh passageway. In FIG. 12 in the lower part of the single toggle 36 there is a twelfth passageway 78. The passageways 74, 76, and 78 are aligned for receiving a pin 80. In FIG. 13 it is seen that the double link 60 has an upper curved arm 82.

Figure 15:
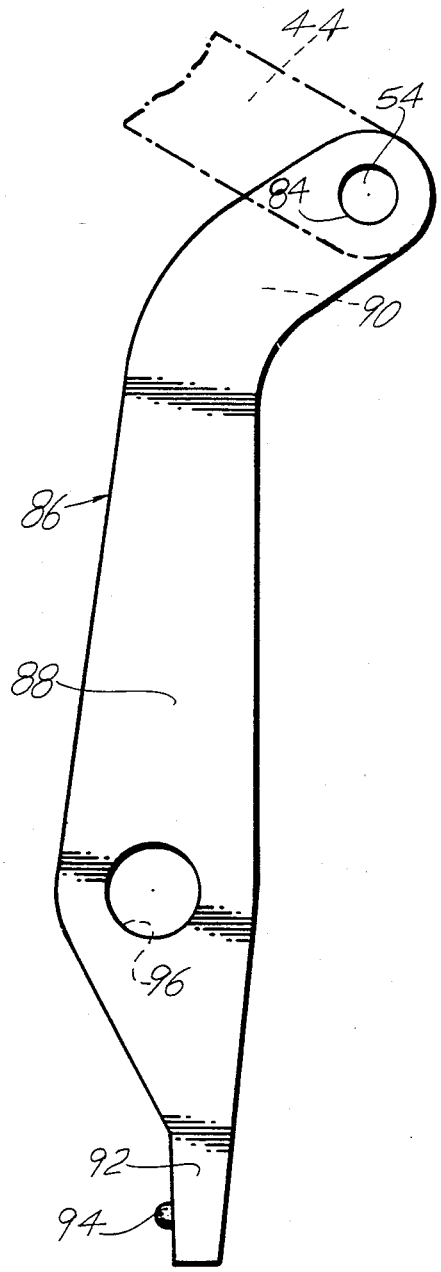
FIG. 15 is a side elevational view of the single link, jaw and stud and the double toggle.
Figure 16:
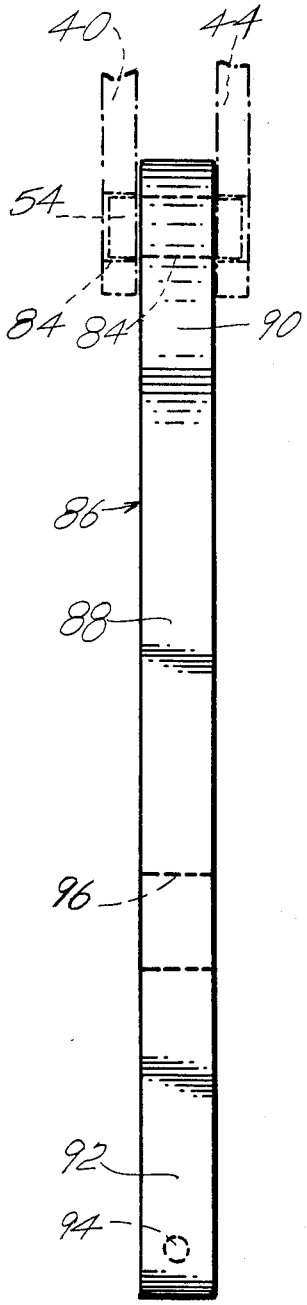
FIG. 16 is an end elevational view of the single link, jaw and stud and the double toggle; and, FIG. 17 is a fragmentary end elevational view of the frame for receiving the plunger, the links and the toggles.

In FIGS. 15 and 16 it is seen that the double toggle comprising members 40 and 44 operatively connect with a single link 86 having a main body 88. In the lower part of the single link 86 there is a lower narrow arm 92 having a stud 94 for operatively co-operating with the recess 64. The single link 86 on its upper end has an upper curved arm 90.

In the single link 86 in the lower part of the main body 88 there is a passageway 96.

In operation the double link 60 and the single link 86 function in such a manner that the main body 88 of the single link 86 is partially positioned between the first arm 66 and the second arm 68 of the double link 60. The ninth passageway 72 of the double link 60 is aligned with a passageway 96 of the single link 86. Part of the single link 86 is between the first arm 66 and the second arm 68 of the double link 60. The double link 60 and the single link 86 operatively connect with a frame 110 for the links 60 and 88 and also for the toggles 40, 36 and 44.

Figure 17:
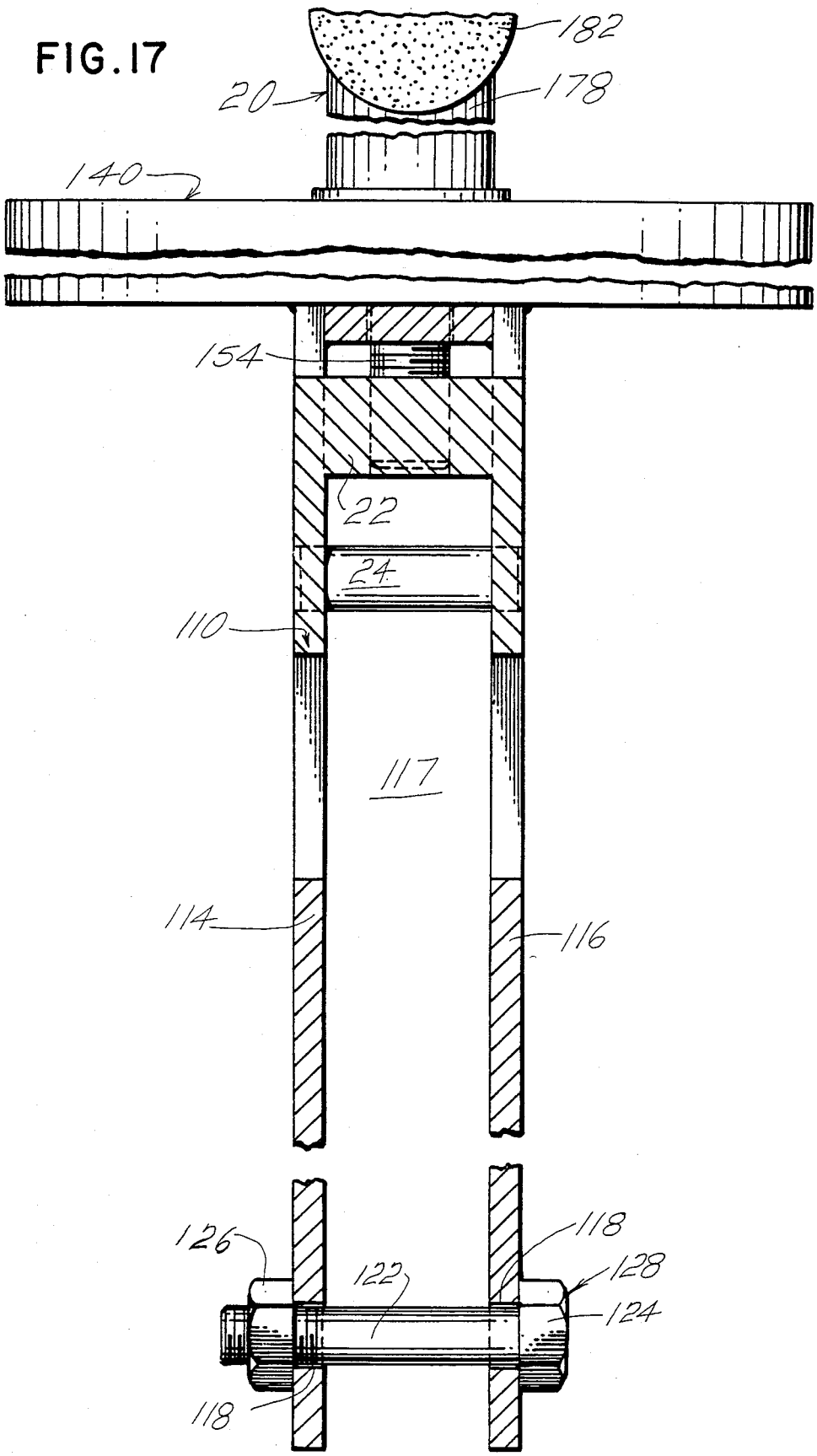

In FIG. 17 there is illustrated a frame 110 for the links and toggles. The frame 110 comprises a base 112, a first leg 114 and a second leg 116. The base 112, the first leg 114, second leg 116 define a recess 117. In the lower part of the first leg 114 and also in the lower part of the second leg 116 are aligned passageways 118. A shaft comprising a bolt having a body portion 122 or a shaft portion 122 is positioned in the passageway 118 in the leg 114 and 116 is also positioned in the passageway 72 of the double link 60 and in the passageway 96 of the single link 86. The bolt can have a hex head 124. On the other end of the bolt there can be a hex head nut 126.

In the first leg 114 and the second leg 116 of the frame 110 there are aligned passageways 128 for receiving a pin 80. The passageways 128 are used when assembling the crimping tool 20.

The double link 60 is moved so that the two passageways 74 and 76 are aligned with the passageways 128. At the same time the single toggle 36 is moved so that the passageway 78 is aligned with the two passageways 128 and also with the passageways 74, 76 and 78. This connects the single toggle 36 with the double link 60. The reader is to understand that the passageways 128 are access passageways for allowing the insertion of the pin 80 into the passageways 74, 76 and 78. After the pin 80 has been inserted into the passageways 74, 76 and 78 the pin 80 is not in the passageways 128. If the pin 80 were in the passageways 128 the single toggle 36 and the double link 60 could not move and rotate.

Also, in the first leg 114 the second leg 116 are aligned passageways 130 for receiving the pin 54. The single link 86 is rotated so that the passageway 84 is aligned with the passageway 130. Also, the first member 40 of the double toggle is rotated so that the sixth passageway 50 is aligned with the passageway 130 and the passageway 84. Further, the second member 44 of the double toggle is rotated so that the passageway 52 is aligned with the passageway 50 and is aligned with the passageway 84 and is aligned with the passageway 130. Then, the pin 54 can be inserted through the passageways 130 and into the passageways 50, 52 and 84. Again, the reader is to understand that the passageways 130 are access passageways for moving the pin 54. After the pin 54 has been positioned in the passageways 50, 52 and 84 the toggle members 40 and 44 and the single link 86 are free to rotate. The pin 54 is of such a length that it does not hinder the movement of the toggle members 40 and 44 and the single link 86.

The power means for moving the plunger 22 and thereby rotating and moving the double link 60 and the single link 86 is a fluid actuating unit comprising a housing 140. The housing 140 is a pneumatic cylinderical member 142 having a top wall 144 and a bottom wall 146. There is an encircling ring 148 encircling the cylinderical housing 140. The encircling ring 148 is a split band. With the removal of 148 there is access to the pneumatic cylindrical housing.

In the lower part of the cylinder 142 there is an airhole 150.

In the upper part of the cylinder 142 there is a movable piston 152. A threaded rod 154 is welded at 156 to the lower surface of the piston 152.

In the bottom wall 146 there is passageway 158. The threaded rod 154 can move in the passageway 158.

In the cylinder 142 there is a spring 160. The spring 160 is wound around the threaded rod 154. The upper part of the spring 160 bears against the lower surface of the movable piston 152. The lower part of the spring 160 bears against the upper surface of the bottom wall 146.

There is also attached to the lower surface of the movable piston 152 a keeper 162 for definitely positioning the upper part of the spring 160.

On the upper surface of the bottom wall 146 there is a keeper 164 which definitely positions the lower part of the spring 160.

In the top wall 144 there is a passageway 166. An adapter 168 connects with the passageway 166 and also connects with a tube 170.

On the lower surface of the bottom wall 146 are positioned two spaced apart threaded studs 172. The studs 172 are welded to the lower surface of the bottom wall 146.

In the base 112 of the frame 110 there are two spaced apart passageways 177. The threaded studs 172 are positioned in the two passageways 177. Then, nuts 174 are screwed onto the lower ends of the threaded rods 172 so as to definitely connect the frame 110 with the pneumatic housing 140.

In the plunger 22 there is a tapped recess 176. The threaded rod 154 is screwed into the tapped recess 176 and the plunger 22.

There is a hollow upright standard 178 having support legs 180. The support legs 180 are attached to the upper surface of the top wall 144 of the cylinder 142. The hollow upright standard 178 receives the tube 170 and acts as a protective housing for the tuve 170.

There is a handle 182 attached to the upper part of the hollow upright standard 178. It is seen that the handle 182 and the standard 178 are at a right angle to each other.

There is a air valve 184 attached to the upright standard 178 and also to the handle 182. There is a valve stem 186 positioned near the handle 182 so that an operator can actuate the air valve 184 or can open the air valve 184 and also can close the air valve 184.

There is an inlet tube 188 which connects with the air valve 182. A flexible tube 190 connects with the inlet tube 188 and also connects with the source 192 of air under pressure.

In the legs 114 and 116 of the frame 110 there are two aligned slots 196. One of the slots 196 is in the leg 114 and the other slot 196 is in the leg 116. The plunger 22 is positioned in these two slots. From the drawings it is seen that the slots have a rectangular configuration. With the plunger 22 positioned in the slots the plunger is restricted to a rectilinear movement. Or, the plunger 22 in the slot 196 is restricted to a back and forth movement or a straight line movement.

In FIGS. 6, 7, 8 and 9 it is seen that there is a steel beam 200. Corrugated sheets 202 of steel are placed on top of the steel beams 200 and are supported by the steel beams 200. The corrugated sheets of steel 202 have lower flat sections 204, upwardly and inwardly sloping sides 206 and upper flat section 208 to give the corrugated configuration. On the right side or right edge of a first sheet of steel 202 there is an upright edge 210. On the left side of the next adjacent corrugated sheet 202 of steel there is an envelope 212 having an outer flap 214 and an inner flap 216. The upright edge 210 is received in the envelope 212 with the outer flap 214 covering one surface of the upright edge 210 and the inner flap 216 covering another surface of the upright edge 210.

The crimping tool 20 can be positioned over the envelope 212 and thereby over the upright edge 210 with the base 62 on one side of the envelope 212 and the lower narrow arm 92 on the other side of the envelope 212. The double link 60 and the single link 86 can be activated so that the base 62 and the lower narrow arm 92 move with respect to each other so that the stud 94 contacts one flap of the envelope 212 so as to push the flap toward the recess 64. The stud 94 in pushing the envelope 212 and the upright edge 210 together forms a deformation in the flaps 214 and 216 in the upright edge 210. For example, in FIG. 7 there is illustrated the deformation 218 in the inner flap 216 and the deformation 220 in the upright edge 210 and the deformation 222 in the outer flap 214. The result is that the upright edge 210 and the flaps 214 and 216 cannot move with respect to each other after the deformations 218, 220 and 222 have been made.

Figure 8:
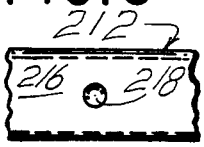
FIG. 8 is a fragmentary side elevational view illustrating the upright edge in the envelope and also illustrating one indent and one recess in the envelope and the upright edge.
Figure 9:
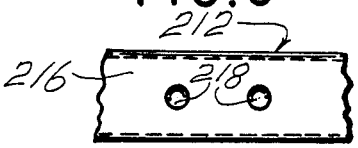
FIG. 9 is a fragmentary side elevational view illustrating the envelope and the upright edge in the envelope and two indents and two recesses.
Figure 10:
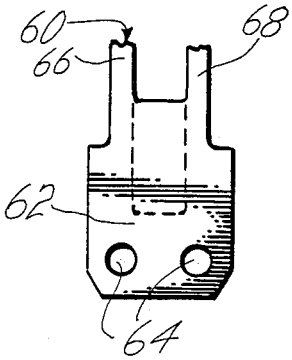
FIG. 10 is a fragmentary end elevational view of a jaw having a double recess as used for making the indents of FIG. 9.
Figure 11:
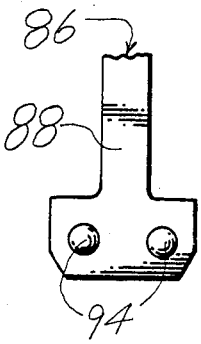
FIG. 11 is a jaw having a double stud for making the indents of FIG. 9.

In FIG. 8 there is illustrated one indent 218 in the inner flap 216. In FIG. 9 there is illustrated two indents 218 in the inner flap 216.

In operation the operator can place the base 62 on one side of the envelope 212 and can place the lower narrow arm 92 on the other side of the envelope 212. Then, the operator can depress the valve stem 186 to the air valve 184 so as to allow air to flow to the pneumatic housing 140. With the air flowing to the pneumatic housing 140 through the pneumatic tube 170 the moveable piston 152 moves downwardly in the cylinder 142. With the moveable piston 152 moving downwardly in the cylinder 142 the threaded rod 154 moves downwardly so as to move the plunger 22 downwardly in the slot 196. The plunger 22, to repeat, moves in a rectilinear path. With the plunger 22 moving downwardly in the slots 196 the toggles 36, 40 and 44 rotate around the pin 24 and move outwardly. With the toggles 36, 40 and 44 moving outwardly the upper curved arm 82 moves outwardly and the upper curved arm 90 moves outwardly. The single toggle 36 and the double link 60 rotate around the pin 80. The toggle members 40 and 44 and the single link 86 rotate around the pin 54. With the upper curved arm 82 moving outwardly and the upper curved arm 90 moving outwardly the double link 60 and the single link 86 rotate around the shaft 182. The base 62 rotates around the shaft 122 and toward the lower narrow arm 92. The lower narrow arm 92 rotates around the shaft 122 and toward the base 62. With the rotation of the base 62 and the lower narrow arm 92 to stud 94 and the recess 64 move and rotate toward each other so as to crimp the upright edge 210, the outer flap 214 and the inner flap 216 to form the indents or deformations 218, 220 and 222.

In this manner the crimping tool 20 can crimp together adjacent corrugated sheets 202 of steel so as to definitely position the sheets with respect to each other.

Figure 4:
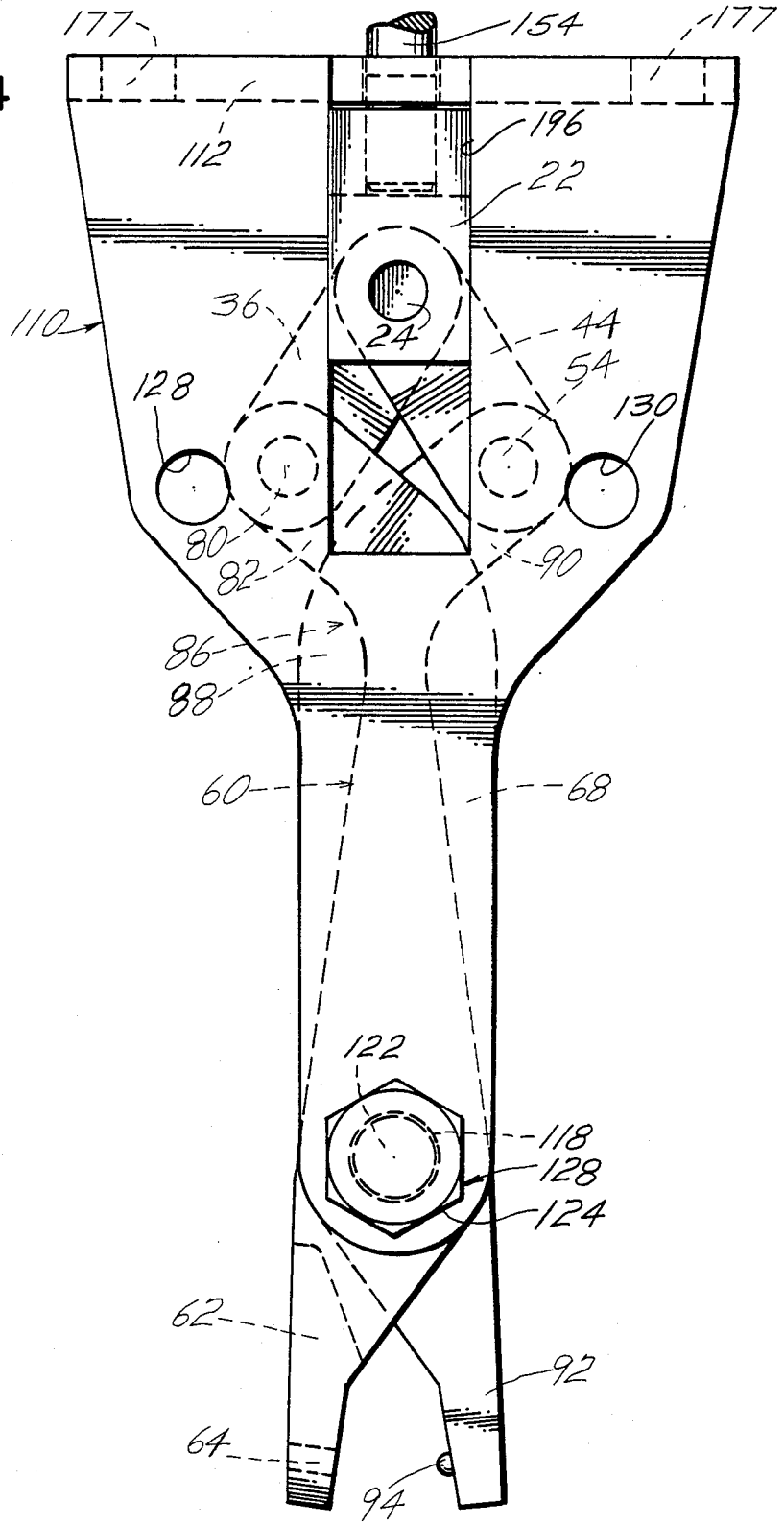
FIG. 4 is a fragmentary side elevational view illustrating the lever mechanism for operating the jaws and with the plunger in an elevated position and with the jaws in an open position.
Figure 5:
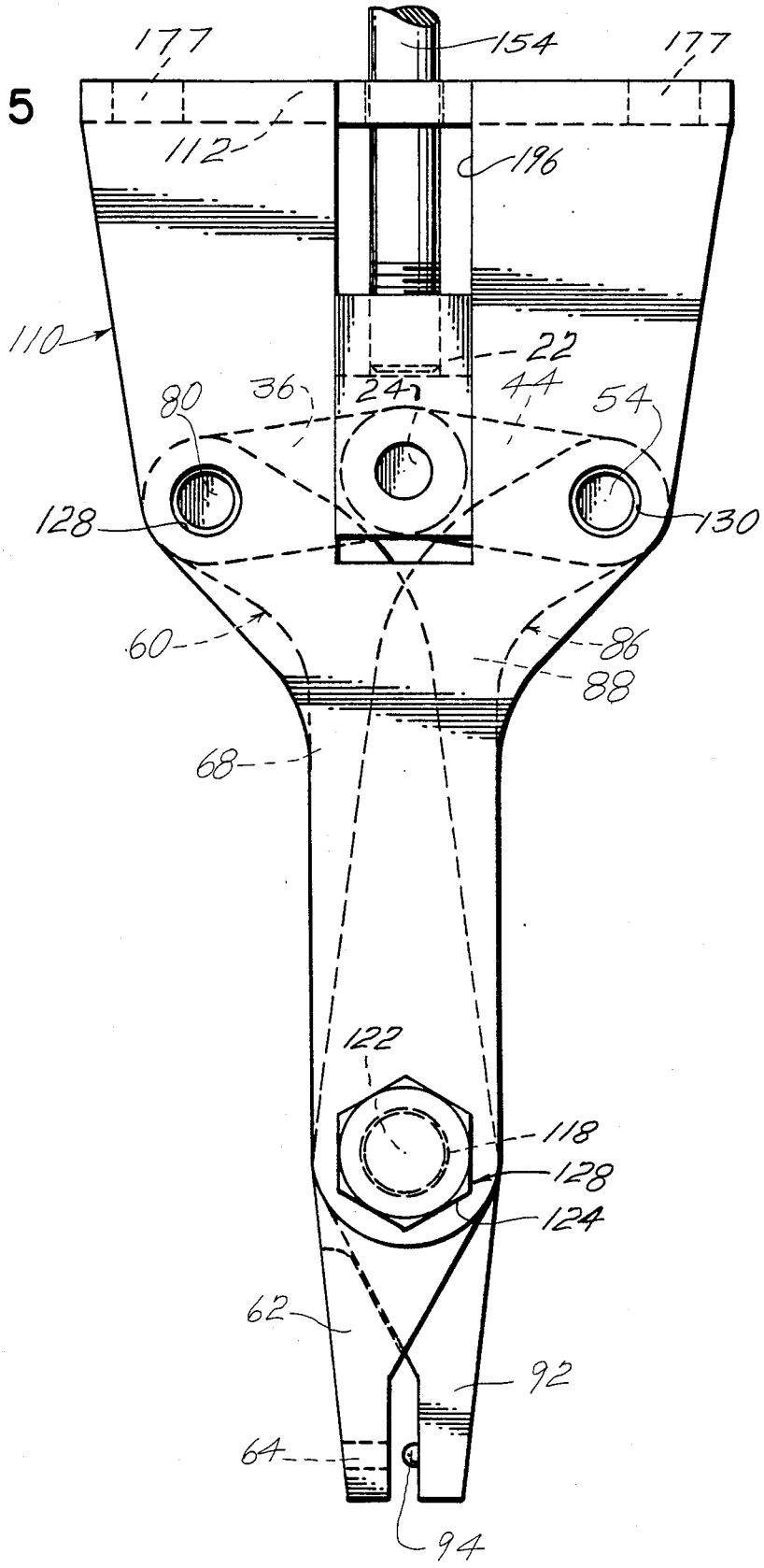
FIG. 5 is a fragmentary side elevational view illustrating the lever mechanism and with the plunger in a lowered position and the jaws closed.
Figure 6:
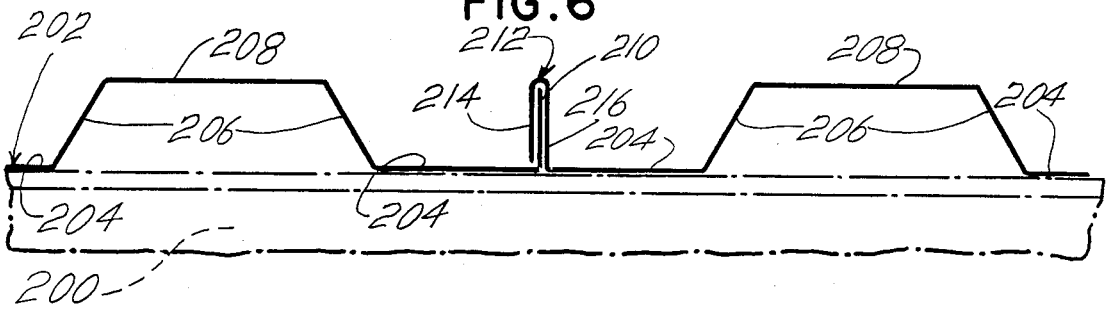
FIG. 6 is an end elevational view of two adjacent corrugated steel forms or two adjacent corrugated sheets illustrating the upright edge of a first steel form with the upright edge being in the envelope of the second steel form and before the envelope and the upright edge have received indents.
Figure 7:
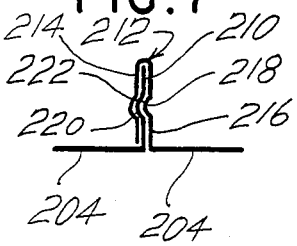
FIG. 7 is an end elevational view illustrating the upright edge in the envelope of the next adjacent sealed form and after the upright edge and the envelope have been indented or have received an indent.

After the corrugated sheets 202 of steel have been crimped the operator will remove his finger from the valve stem 188. The pneumatic pressure in the cylinder 142 between the top wall 144 and the movable piston 152 will decrease. The spring 160 will move the movable piston 152 toward the top wall 144. Then, the plunger 22 will move upwardly in the slot 196. The single toggle 36 and the double toggles 40 and 44 will rotate so as to be in more up and down position, see FIG. 4. Likewise, the upper curved arm 82 and the upper curved arm 90 will rotate toward each other and the double link 60 and the single link 86 will overlie each other to a degree, see FIG. 4. The result is that the base 62 and the lower narrow arm 92 move away from each other and the recess 64 and the stud 94 move away from each other. The operator can slide the crimping tool along the envelope 212, for a few inches or a few feet, and then activate the valve 184 again to crimp the envelope 212 in a different place or position so as to more firmly position the two adjacent corrugated sheets 202 of steel with respect to each other.

The air hole 150 in the lower part of the cylinder 142 is to allow the escape of air from the cylinder 142 and the moveable piston 152 moves downwardly in the cylinder 142. This lessens the resistance to the movement of the movable piston 152 in the cylinder 142.

RESUME

From the foregoing it is seen that I have provided a power crimping tool for crimping together two adjacent sheets of metal. The power crimping tool 20 comprises a pneumatic housing 140 in the configuration of a cylinder 142. In the cylinder 142 there is a movable piston 152. The movable piston connects with a rod 154. In turn, the rod 154 connects with the plunger 22. The plunger 22 is restricted in motion to a rectilinear path.

The plunger 22 connects the toggle 36. In turn, the toggle 36 connects with the link 60. Also, the plunger 22 connects with two toggles 40 and 44. The two toggles 40 and 44 connect with a link 86. The links 60 and 86 rotate around the shaft 122.

On the lower end of the link 60 there is a recess 64. On the lower end of the link 86 there is a stud 94.

With the application of air under pressure to the pneumatic housing 140 the movable piston 152 moves in a rectilinear path in the cylinder 142. With the movable piston 152 moving downwardly, the plunger 22 moves downwardly so as to move the toggle 36 and the link 60 and also to move the toggles 40 and 44 and the link 86. With the plunger 22 moving downwardly the links 60 and 86 rotate around the shaft 122 so as to rotate the recess 64 and the stud 94 towards each other to crimp two adjacent sheets of metal.

With the air pressure removed from the pneumatic housing 140 a spring moves the movable piston 152 upwardly in the cylinder 142. The plunger 22 also moves upwardly. That end of the toggle 36 which connects with the plunger 22 moves upwardly so as to rotate the link 60. With the rotation of the link 60 the recess 64 moves away from the stud 94. With the plunger 22 moving upwardly both parts of the toggles 40 and 44 which connect with the plunger 22 also move upwardly so as to rotate the link 86. The stud 94 and the link 86 rotate away from the recess 64. The recess 64 and the stud 94 are separated from the two crimped sheets of metal so that the crimping tool 20 can be moved along the two adjacent sheets of metal so as to be, once again, activated to crimp the two adjacent sheets of metal at another place or location.

From the foregoing description of my invention, it is seen that I have provided a crimping tool comprising a first movable link; a second movable link; with said first movable link having a first crimping means; with said second movable link having a second crimping means for operatively cooperating with said first crimping means to crimp an object; a first toggle link operatively connecting with said first movable link; a second toggle link operatively connected with second movable link; a moving means operatively connecting with said first toggle link and operatively connecting with said second toggle link for moving said first crimping means and said second crimping means with respect to each other. The moving means comprises a plunger and there is a plunger actuating means operatively connecting with the plunger for moving the plunger. The plunger actuating means comprises a movable piston operativley connecting with the plunger for moving the plunger. There is a first pin connecting with said first movable link and said second movable link and whereby said first movable link and said second movable link are capable of rotating around said first pin. A second pin connects with said first toggle link and said first movable link and said first toggle link and said first movable link are capable of rotating around said second pin. Further, a third pin connects with said second toggle link and said second movable link and said second toggle link and said second movable link are capable of rotating around said third pin. There is a fluid actuated cylinder with said movable piston being in said fluid actuated cylinder. A source of fluid connects with said cylinder for moving said movable piston. There is a control means operatively connecting with said source of fluid for controlling the flow of fluid to said cylinder and for controlling the movement of said piston. A return means operativley connects with said piston for moving said piston. The fluid moves said movable piston in a first direction and the return means, being a spring, moves said piston in a second direction with said first direction and and said second direction being opposite direction. The crimping tool comprises a frame and with said frame having a leg. There is a slot in said leg. A plunger operatively connects with said slot and moves in said slot in a rectilinear movement. The first crimping means is a stud and the second cirmping means is a recess. It is possible to move the stud and the recess with respect to each other so that the stud presses the two pieces of metal close to each other and with the aid of the recess forms a crimp in the two pieces of metal so as to assist in definitely positioning the two pieces of metal with respect to each other. Also, the spring moves the movable piston which moves the plunger so that the stud and the recess move away from each other to allow the crimping tool to be moved with respect to the two pieces of metal which have been crimped.

An advantage of my power operated crimping tool as compared to a manual operated crimping tool is that with the power tool there is more output or more crimps or indents in a unit of time than with the manual tool. With a greater output there is less expense for crimping together sheets of metal. With the power tool the cost of crimping together sheets of metal is less than with a manual tool. Also, another advantage is that the worker in using the power tool has less fatigue than a worker using the manual tool. With less fatigue there is a greater output from the power tool or there are more crimps with the power tool than with the manual tool. Also, with less fatigue the worker is more alert than a worker using the manual tool and with the worker being more alert there is less possibility of an accident for a worker using a power tool as compared to a worker using a manual tool. A further factor with respect to the power tool is that there is a higher quality of work from the worker using the power tool as compared to the manual tool as a laborer does not get as tired with the air actuated crimping tool as compared to the manually actuated crimping tool.

A modification of this crimping tool is adaption of the stud 94 on the arm 92 and the base 62 around the recess 64 to be electrodes. With an appropriate supply of electricity the edge 210 and the flaps 214 and 216 are spot welded into an integral unit. The welding of the sheet metal into an integral unit adds stability to the steel subfloor.

From the foregoing and having presented my invention what I claim is:

1. A crimping tool comprising:

a. a fluid actuated cylinder;

b. a moveable piston in said fluid actuated cylinder;

c. a rod connecting with said piston and part of said rod being outside of said fluid actuated cylinder;

d. a frame comprising a base, a first leg and a second leg;

e. said first leg and said second leg being spaced apart;

f. a first slot in said first leg;

g. a second slot in said second leg;

h. a plunger positioned in and moveable in said first slot and in said second slot;

i. said plunger having a base, a first leg and a second leg which are spaced apart;

j. said rod and said plunger operatively connecting together;

k. a passageway in said base and said rod being in said passageway;

l. a shaft operatively connecting with said first leg and with said second leg of said plunger;

m. a single toggle operatively connecting with said shaft;

n. a toggle operatively connecting with said shaft;

o. a link;

p. said single toggle and said link operatively connecting together to allow movement between them;

q. a single link;

r. said toggle and said single link operatively connecting together to allow movement between them;

s. a passageway in the first leg of said frame and a passageway in the second leg of said frame and a shaft in said passageways identified as a frame shaft;

t. said link having a passageway and said frame shaft being in said passageway;

u. said single link having a passageway and said frame shaft being in said passageway;

v. said link extending beyond said frame shaft into a base;

w. said single link extending beyond said frame shaft into a narrow arm;

x. said base of said link and said narrow arm upon being juxtapositioned functioning to crimp an object;

y. means operatively connecting together said first actuated cylinder and said base; and, z. a means for the introduction of fluid under pressure to said first actuated cylinder to move said piston to move said toggle and to move said single toggle so as to move said link and to move said single link toward each other and near each other to position said base of said link and said narrow arm of said single link adjacent to each other.

2. A crimping tool according to claim 1 and comprising:

a. a means for controlling the introduction of fluid under pressure to said first actuated cylinder.

3. A crimping tool according to claim 1 and comprising:

a. a means for positioning said piston and said link and said single link so that, in the absence of fluid under pressure in said first actuated cylinder, said base and said narrow arm are spaced apart in a normally open position.

4. A crimping tool according to claim 21 and comprising:

a. a pin connecting together said single toggle and said link with respect to each other;

b. a hole in one of said legs of said frame for adjustment of said pin connecting together said single toggle and said link;

c. a pin connecting together said toggle and said single link for allowing rotation of said toggle and said single link with respect to each other; and, d. a hole in one of said legs of said frame for adjustment of said pin connecting together said toggle and said single link.

5. A crimping tool according to claim 1 and comprising:

a. said link comprising a base, and a first arm and a second arm connecting with said base;

b. part of said single toggle being positioned between said first arm and said second arm;

c. said toggle being a double toggle comprising two toggle members; and, d. part of said single link being positioned between said two toggle members.

6. A crimping tool according to claim 5 and comprising:

a. a means for controlling the introduction of fluid under pressure to said first actuated cylinder;

b. a means for positioning said piston and said link and said single link so that, in the absence of fluid under pressure in said first actuated cylinder, said base and said narrow arm are spaced apart in a normally open position;

c. a pin connecting together said single toggle and said link with respect to each other;

d. a hole in one of said legs of said frame for adjustment of said pin connecting together said single toggle and said link;

e. a pin connecting together said toggle and said single link for allowing rotation of said toggle and said single link with respect to each other; and, f. a hole in one of said legs of said frame for adjustment of said pin connecting together said toggle and said single link.

7. A crimping tool according to claim 1 and comprising:

a. said narrow arm of said single link having a stud; and, b. said base of said link having a recess aligned with said stud for crimping an object.

8. A crimping tool according to claim 6 and comprising:

a. said narrow arm of said single link having a stud; and, b. said base of said link having a recess aligned with said stud for crimping an object.

9. A crimping tool for crimping a deformable material:

A. Said crimping tool comprising:

a. a fluid actuated cylinder;

b. a moveable piston in said fluid actuated cylinder;

c. a rod connecting with said piston and part of said rod being outside of said fluid actuated cylinder;
d. a frame comprising a base, a first leg and a second leg;
e. said first leg and said second leg being spaced apart;
f. a first slot in said first leg;
g. a second slot in said second leg;
h. a plunger positioned in and moveable in said first slot and in said second slot;
i. said plunger having a base, a first leg and a second leg which are spaced apart;
j. said rod and said plunger operatively connecting together;
k. a passageway in said base and said rod being in said passageway;
l. a shaft operatively connecting with said first leg and with said second leg of said plunger;
m. a single toggle operatively connecting with said shaft;
n. a toggle operatively connecting with said shaft;
o. a link;
p. said single toggle and said link operatively connecting together to allow movement between them;
q. a single link;
r. said toggle and said single link operatively connecting together to allow movement between them;
s. a passageway in the first leg of said frame and a passageway in the second leg of said frame and a shaft in said passageways identified as a frame shaft;
t. said link having a passageway and said frame shaft being in said passageway;
u. said single link having a passageway and said frame shaft being in said passageway;
v. said link extending beyond said frame shaft into a base;
w. said single link extending beyond said frame shaft into a narrow arm;
x. said base of said link and said narrow arm upon being juxtapositioned functioning to crimp an object;
y. means operatively connecting together said first actuated cylinder and said base;
z. a means for the introduction of fluid under pressure to said first actuated cylinder to move said piston to move said toggle and to move said single toggle so as to move said link and to move said single link toward each other and near each other to position said base of said link and said narrow arm of said single link adjacent to each other; and, wherein said deformable material being engaged by said crimping tool with said base of said link being on a first surface of said deformable material and said narrow arm of said single link being on a second surface of said deformable material for clamping and deforming said deformable material.

10. A crimping tool according to claim 9 and comprising:

a. a means for controlling the introduction of fluid under pressure to said first actuated cylinder.

11. A crimping tool according to claim 9 and comprising:

a. a means for positioning said piston and said link and said single link so that, in the absence of fluid under pressure in said first actuated cylinder, said base and said narrow arm are spaced apart in a normally open position.

12. A crimping tool according to claim 9 and comprising:

a. a pin connecting together said single toggle and said link with respect to each other;
b. a hole in one of said legs of said frame for adjustment of said pin connecting together said single toggle and said link;
c. a pin connecting together said toggle and said single link for allowing rotation of said toggle and said single link with respect to each other; and,
d. a hole in one of said legs of said frame for adjustment of said pin connecting together said toggle and said single link.

13. A crimping tool according to claim 9 and comprising:

a. said link comprising a base, and a first arm and a second arm connecting with said base;
b. part of said single toggle being positioned between said first arm and said second arm;
c. said toggle being a double toggle comprising two toggle members; and,
d. part of said single link being positioned between said two toggle members.

14. A crimping tool according to claim 13 and comprising:

a. a means for controlling the introduction of fluid under pressure to said first actuated cylinder;
b. a means for positioning said piston and said link and said single link so that, in the absence of fluid under pressure in said first actuated cylinder, said base and said narrow arm are spaced apart in a normally open position;
c. a pin connecting together said single toggle and said link with respect to each other;
d. a hole in one of said legs of said frame for adjustment of said pin connecting together said single toggle and said link;
e. a pin connecting together said toggle and said single link for allowing rotation of said toggle and said single link with respect to each other; and,
f. a hole in one of said legs of said frame for adjustment of said pin connecting together said toggle and said single link.

15. A crimping tool according to claim 9 and comprising:

a. said narrow arm of said single link having a stud; and,
b. said base of said link having a recess aligned with said stud for crimping an object.

16. A crimping tool according to claim 14 and comprising:

a. said narrow arm of said single link having a stud; and,
b. said base of said link having a recess aligned with said stud for crimping an object.

* * * * *